US008015660B2

(12) United States Patent
Bruntner

(10) Patent No.: US 8,015,660 B2
(45) Date of Patent: Sep. 13, 2011

(54) VACUUMING DEVICE

(75) Inventor: Eugen Bruntner, Schlierbach (DE)

(73) Assignee: Electrostar Schöttle GmbH & Co. KG, Reichenbach (DE)

( * ) Notice: Subject to any disclaimer, the term of this patent is extended or adjusted under 35 U.S.C. 154(b) by 504 days.

(21) Appl. No.: 12/258,385

(22) Filed: Oct. 25, 2008

(65) Prior Publication Data

US 2009/0106933 A1 Apr. 30, 2009

(30) Foreign Application Priority Data

Oct. 26, 2007 (DE) ..... 20 2007 015 242 U

(51) Int. Cl.
*A47L 9/10* (2006.01)

(52) U.S. Cl. ..... 15/347; 15/352

(58) Field of Classification Search ..... 15/347, 15/352, 353; 55/283, 284, 299, 300, 337, 55/428, 429, DIG. 3
See application file for complete search history.

(56) References Cited

U.S. PATENT DOCUMENTS

| | | | | |
|---|---|---|---|---|
| 7,743,460 | B2 * | 6/2010 | Heinrichs | 15/352 |
| 2007/0186372 | A1 * | 8/2007 | Rowntree et al. | 15/347 |
| 2009/0000485 | A1 | 1/2009 | Valentini | |

FOREIGN PATENT DOCUMENTS

| | | | |
|---|---|---|---|
| DE | 10101219 | A1 | 7/2002 |
| EP | 1629762 | B2 | 3/2006 |
| EP | 1997415 | A | 3/2008 |
| IT | MI20071121 | A1 | 9/2007 |

* cited by examiner

*Primary Examiner* — Dung Van Nguyen
(74) *Attorney, Agent, or Firm* — Gudrun E. Huckett

(57) ABSTRACT

A vacuuming device has a housing having an air intake and at least one air outlet opening. A suction motor is arranged in the housing. At least two filters are arranged in the housing and each has a flow passage to the suction motor, wherein dirty air sucked into the housing by the suction motor passes through the at least two filters and exits through the at least one air outlet opening. The at least two filters each are provided with a cleaning device and a valve device adapted to close off the flow passage to the suction motor, respectively, as needed.

9 Claims, 1 Drawing Sheet

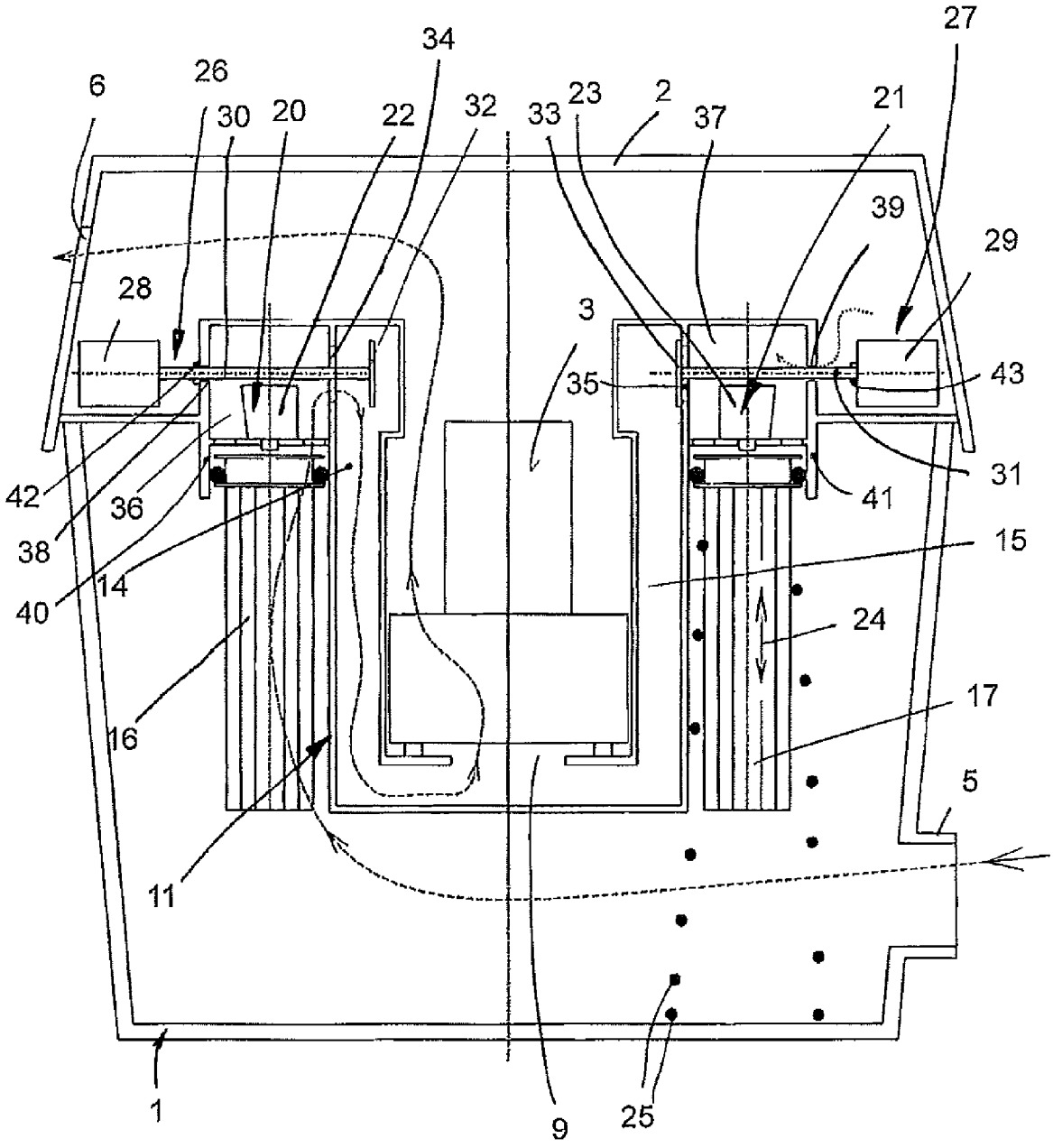
6
26
30
20
22
34
32
33
23
2
37
21
27
39
29
28
3
35
43
42
36
38
40
14
41
31
15
24
16
17
5
11
1
9
25

VACUUMING DEVICE

BACKGROUND OF THE INVENTION

The invention relates to a vacuuming device comprising a housing in which a suction motor and at least two filters are arranged. Each filter is provided with a cleaning device. Dirty air that is sucked-in by the suction motor passes through the filters and exits the housing through at least one air outlet opening.

A vacuuming device is known that has in its housing two suction motors each provided with a filter. Each suction motor has an air outlet opening that can be closed off by a shut-off valve when the filter must be cleaned. When doing so, the correlated suction motor is switched off and by means of the shut-off valve the air outlet opening of the turned-off suction motor is closed. The two suction motors require a correspondingly large housing. Cleaning of the filters can be done only when the suction motor has reduced its engine speed such that a suction effect is no longer present. The slow-down time of the suction motor is within a range of seconds.

It is an object of the present invention to design a vacuuming device of the aforementioned kind in such a way that, while the device has a compact configuration, the cleaning process of the filter can be initiated immediately when required without there being any idle time.

SUMMARY OF THE INVENTION

In accordance with the present invention, this is achieved in that each filter has assigned thereto a valve device with which a flow passage from the filter to the suction motor can be closed off.

In the vacuuming device according to the present invention there is only a single suction motor provided so that the housing of the vacuuming device is very compact. The suction motor remains in operation during the vacuuming operation and during the cleaning process so that idle time for cleaning the respective filters does not occur. In order to clean a filter, the corresponding valve device is actuated so that the flow passage of the clean air from the filter to the suction motor is closed off. This blocking action can be done suddenly so that the cleaning process can be initiated immediately thereafter. The suction motor remains switched on and operates at full power so that it is possible to continue vacuuming with the vacuuming device. The dirty air then flows only through that one of the two or more filters where the flow passage to the air outlet opening has not been closed off. When the cleaning process is completed, the valve device is returned into the initial position so that the flow passage from the now cleaned filter to the air outlet opening is released again. In this way, the filters can be alternatingly cleaned as needed. As long as the two filters have not been clogged, the sucked-in dirty air flows through both filters.

Preferably, a flow chamber that is arranged in the flow direction downstream of the filter is separated from a downstream flow channel when cleaning the filter which flow channel is in fluid communication with the suction motor. The flow chamber and the downstream flow channel enable a simple and reliable blockage of the flow passage when the filter must be cleaned.

A constructively simple configuration is provided when the valve device has a moveable plunger that is provided with a valve element. By moving the plunger together with the valve element, the flow passage can be interrupted or released in a simple way within a very short period of time.

Advantageously, the plunger is moved electromagnetically, in particular by a lifting magnet.

In order to protect the lifting magnet from dirt/dust particles, it is advantageously arranged outside of the flow chamber.

The plunger projects through an opening in a wall of the flow chamber. The opening diameter of this opening is greater than the diameter of the plunger. During the cleaning process this opening is not sealed off so that underpressure in the flow direction will immediately collapse downstream of the filter to be cleaned and the filter cleaning action can be immediately started.

After completion of the filter cleaning process, this opening is closed by a sealing element positioned on the plunger so that the underpressure or vacuum required for the vacuuming action is immediately generated in the flow direction behind the filter.

The plunger of the valve device projects advantageously through a further opening in a further wall of the flow chamber. By means of this further opening the flow chamber is in communication with the flow channel.

Advantageously, the diameter of the plunger is several times smaller than the width of this further opening. In this way, it is ensured that during the vacuuming process the taken-in air, after passing through the filter, flows quickly into the flow channel and from there in the direction toward the air outlet opening.

Expediently, the valve element is located at the free end of the plunger, preferably in the flow channel. In this way, it is achieved that upon movement of the plunger the valve element closes off the further opening and the sealing element releases the other opening at the same time. The valve element must not ensure a hundred percent sealing action at the further opening during the cleaning process of the filter. Leaking air that possibly enters through the valve element in the closing position has no disadvantageous effect because the opening cross-section of the opposite opening that is released by the sealing element is significantly larger than the leakage cross-section.

The suction motor is positioned advantageously centrally within the housing and the filters are arranged in the area adjacent to the vacuum motor. Such an arrangement provides not only a very compact design of the housing and thus of the entire vacuuming device but also enables an optimal course of the airflow within the housing.

BRIEF DESCRIPTION OF THE DRAWING

The only FIGURE shows a schematic illustration of a vacuuming device according to the invention.

DESCRIPTION OF THE PREFERRED EMBODIMENTS

The vacuuming device comprises a container 1 on which a cover or hood 2 is detachably fastened to form a housing. In the container 1 a suction motor 3 is arranged preferably centrally. The vacuuming device is provided with an intake socket 5 to which a vacuum hose can be connected. The hood 2 is provided with at least one air outlet opening 6 through which the filtered air exits the vacuuming device. The suction motor 3 is seated on a support unit 11.

The vacuuming device has two filters 16, 17 that advantageously are of the same configuration and each comprise a folded filter medium. The two filters 16, 17 extend advantageously perpendicularly to the drawing plane.

Each filter 16, 17 has correlated therewith a cleaning device 20, 21 with which the respective filter 16, 17 can be cleaned when it has been clogged by dust/dirt particles. The cleaning devices 20, 21 are shaking devices, generally known in the art, with a shaking magnet 22, 23 with which the filters 16, 17 can be caused to perform vertical vibrations as indicated in the drawing for filter 17 by the double-pointed arrow 24. The shaking movements in the vertical direction have the effect that the dust/dirt particles 25 adhering to the filtered medium will be shaken off and drop down into the dirt collecting container 1.

Each filter 16, 17 has a valve device 26, 27 correlated therewith with which during the cleaning phase of the filter 16 or 17 the flow passage from the intake socket 5 to the air outlet opening 6 can be closed off. Both valve devices 26, 27 are advantageously of same configuration and provided on the support unit 11. The valve devices 26, 27 have each a lifting magnet 28, 29 with which a plunger 30, 31 can be axially moved. At the free end of the plunger 30, 31 a valve disk 32, 33 is provided with which an opening 34, 35 of the support unit 11 can be closed. The opening 34, 35 connects flow channel 14, 15 with a flow chamber 36, 37, respectively, in which the shaking magnet 22, 23 of the cleaning device 20, 21 is located. The flow channels 14, 15 and the flow chambers 36, 37 constitute a flow passage between filter 16, 17 and suction motor 3, respectively.

The plunger 30, 31 projects through an opening 38, 39 provided in the wall 40, 41; the opening 38, 39 is positioned opposite the opening 34, 35 at a distance. The wall 40, 41 delimits the respective flow chamber 36, 37 outwardly relative to the interior of the housing. The opening cross-section of the openings 38, 39 is significantly smaller than the opening cross-section of the openings 34, 35.

On the plunger 30, 31 a sealing element 42, 43 is seated that, for example, is formed by a short hose section. The two lifting magnets 28, 29 are located outside of the flow chambers 36, 37. The lifting magnets 28, 29 can be encapsulated.

In the drawing, the plunger 30 of the valve device 26 is extended so that the valve disk 32 releases the opening 34 of the support unit 11. The sealing element 42 rests against the outer surface of the wall 40 and properly seals off the opening 38 in the wall 40. If the filter 17 is not yet clogged with dust/dirt particles 25, the plunger 31 of the valve device 27 is extended so that the valve disk 33 releases the opening 35 and the sealing element 43 seals the opening 39 in the wall 41. By means of the suction motor 3 the air that is contaminated with dust/dirt particles 25 is sucked in by means of the suction socket 5 and flows through the filters 16, 17 into the flow chambers 36, 37. The dust/dirt particles 25 are retained in the filter 16, 17 so that cleaned exhaust air flows into the flow chambers 36, 37. By means of openings 34, 35 the exhaust air passes into the flow channels 14,15. The exhaust air flows subsequently through an air passage 9 and from there through the air outlet opening 6 into the environment. In the drawing the flow of air is indicated by the dashed line for the filter 16.

The filters 16, 17 are sequentially cleaned by underpressure control or time control. For this purpose, the valve device 26, 27 is automatically switched, in the illustrated embodiment, the valve device 27. The lifting magnet 29 pulls back the plunger 31 so that the valve disk 33 closes off the opening 35. At the same time, the sealing element 43 lifts off the opening 39. By switching on the lifting magnet 29 the plunger 31 is suddenly moved into the closed position. Since the opening 39 has a greater diameter than the plunger 31, the underpressure behind the filter 17 in the flow chamber 37 suddenly collapses. In this way, it is possible to actuate directly thereafter the cleaning device 21, i.e., to actuate the shaking magnet 23. The filter 17 is then reciprocated in the direction of the double-pointed arrow 24. By means of this shaking movement the dust/dirt particles 25 adhering to the filter medium of the filter 17 are shaken off and the filter medium is cleaned.

The valve disk 33 must not seal off the opening 31 to 100 percent. In this way, the valve disk 33 can be an inexpensive sealing element without this having disadvantages with regard to cleaning the filters 16, 17. The opening 39 whose diameter is somewhat greater than the diameter of the plunger 31 is open when the opening 35 is closed so that air leaking through this opening 35 into the flow chamber 37 can be quickly compensated. The passage cross-section in the area of the opening 39 is greater than the leakage cross-section in the area of the valve disk 33 so that the leakage air entering the flow chamber 37 can be reliably compensated. The under pressure generated by the suction motor 3 is reliably dissipated by the opening 39 because, as described, the flow cross-section of the opening 39 is significantly greater than the leakage cross-section in the area of the valve disk 33.

While the filter 17 is being cleaned, the vacuuming device can continue to operate because the valve disk 32 of the plunger 30 of the valve device 26 does not close off the opening 34. The exhaust air that is sucked in by the suction motor 3, as indicated in the drawing by the flow arrows, can therefore pass through the filter 16 into the chamber 36, through the opening 34 into the flow channel 14, and then flow through the air passage 9 and through air outlet opening 6 to the exterior. The suction motor 3 operates at full power so that the vacuuming action is not impaired by cleaning the filter 17.

As soon as the cleaning process has been completed, the lifting magnet 29 is switched off and the plunger 31 is extended by the vacuum generated by the suction motor 3 so that the valve disk 33 releases the opening 35 and at the same time the sealing element 43 closes off tightly the opening 39. This switching process is again done suddenly. In this way, the filter 17 is again connected to the flow passage for the dust/dirt-laden air so that the air can also pass through the filter 17.

Subsequently, the lifting magnet 28 is switched on and the plunger 30 is returned. The valve disk 32 closes off the opening 34 while the sealing element 43 releases the opening 38. Now the filter 16 can be cleaned in the described way. During this cleaning process the filter 17 continues to operate so that during cleaning of the filter 16 the vacuuming action of the vacuuming device is not impaired.

The two filters 16, 17 can be thus be cleaned alternatingly. The suction motor 3 operates continuously at constant high power/output so that the vacuuming performance of the vacuuming device remains unchanged even when one of the filters 16 or 17 is cleaned. The vacuuming device is characterized by a compact configuration because only one suction motor 3 is used that is arranged centrally in the container 1. The support unit 11 is detachably arranged in the container 1 so that it can be removed if needed. Despite the single suction motor 3 the vacuuming device can be utilized over an extended period of time until the container 1 must be emptied. Since the filters 16, 17 are cleaned alternatingly, during the vacuuming process there is no idle time because one of the filters 16 or 17 is always operative. Basically it is possible to provide the vacuuming device with more than two filters that each have the valve device and a cleaning device correlated therewith. In this case, the filters can be alternatingly cleaned in the described way by time control while the other filters continue their work.

The specification incorporates by reference the entire disclosure of German priority document 20 2007 015 242.6 having a filing date of Oct. 26, 2007.

While specific embodiments of the invention have been shown and described in detail to illustrate the inventive principles, it will be understood that the invention may be embodied otherwise without departing from such principles.

What is claimed is:

1. A vacuuming device comprising:

a housing having an air intake and at least one air outlet opening;

a suction motor arranged in the housing;

at least two filters arranged in the housing and each having a flow passage to the suction motor, wherein dirty air sucked into the housing by the suction motor passes through the at least two filters and exits through the at least one air outlet opening;

wherein the at least two filters each are provided with a cleaning device and a valve device adapted to close off the flow passage to the suction motor, respectively, as needed;

wherein the flow passages each comprise a flow chamber and a flow channel arranged downstream of the flow chamber, wherein the flow channel is in flow communication with the suction motor;

wherein the valve devices each comprise a moveable plunger provided with a valve element and a sealing element, the valve element and the sealing element fixedly connected to the plunger;

wherein the flow chamber has a first wall with a first opening and has a second wall with a connecting opening that is opposite the first opening and that connects the flow chamber to the flow channel, wherein the plunger passes through the first opening and the connecting opening;

wherein the plunger has a first end position and a second end position and is moved by a single stroke from the first to the second end position and the second to the first end position;

wherein in the first end position the plunger seals the first opening in the first wall with the sealing element while the connecting opening is open;

wherein in the second end position the plunger closes off the connecting opening with the valve element and separates the flow chamber from the flow channel, while the first opening is open.

2. The vacuuming device according to claim 1, wherein the valve devices each comprise a lifting magnet acting on the plunger.

3. The vacuuming device according to claim 2, wherein the lifting magnet is positioned external to the flow chamber, respectively.

4. The vacuuming device according to claim 1, wherein a diameter of the first opening is greater than a diameter of the plunger.

5. The vacuuming device according to claim 1, wherein a diameter of the second opening is greater than the diameter of the plunger.

6. The vacuuming device according to claim 1, wherein the valve element is arranged on a free end of the plunger.

7. The vacuuming device according to claim 6, wherein the valve element is positioned in the flow channel.

8. The vacuuming device according to claim 1, wherein the suction motor is centrally arranged in the housing.

9. The vacuuming device according to claim 1, wherein the at least two filters are arranged adjacent to the suction motor.

* * * * *